US006572493B2

(12) United States Patent
Ohama

(10) Patent No.: US 6,572,493 B2
(45) Date of Patent: Jun. 3, 2003

(54) MULTI-PIECE SOLID GOLF BALL

(75) Inventor: Keiji Ohama, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/873,223

(22) Filed: Jun. 5, 2001

(65) Prior Publication Data

US 2002/0019273 A1 Feb. 14, 2002

(30) Foreign Application Priority Data

Jun. 5, 2000 (JP) ..... 2000-167747

(51) Int. Cl.[7] ..... A63B 37/02
(52) U.S. Cl. ..... 473/373; 473/376
(58) Field of Search ..... 473/373, 374, 473/376, 367, 368, 370

(56) References Cited

U.S. PATENT DOCUMENTS

| | | | | |
|---|---|---|---|---|
| 4,714,253 A | * | 12/1987 | Nakahara et al. | 473/373 |
| 4,863,167 A | * | 9/1989 | Matsuki et al. | 473/374 |
| 5,002,281 A | * | 3/1991 | Nakahara et al. | 473/373 |
| 5,184,828 A | * | 2/1993 | Kim et al. | 473/373 |
| 5,556,098 A | | 9/1996 | Higuchi et al. | |
| 6,004,226 A | | 12/1999 | Asakura | |
| 6,045,459 A | | 4/2000 | Sugimoto et al. | |

FOREIGN PATENT DOCUMENTS

| | | |
|---|---|---|
| JP | 4-48473 | 8/1992 |
| JP | 7-24084 | 1/1995 |
| JP | 9-322948 | 12/1997 |
| JP | 10-216271 | 8/1998 |
| JP | 11-151320 | 6/1999 |

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

The present invention provides a multi-piece solid golf ball having very soft and good shot feel, and excellent rebound characteristics and flight performance, when hit by a golfer who swings a golf club at low head speed. The present invention relates to a multi-piece solid golf ball comprising a core consisting of an inner core and an outer core, and at least one layer of cover, wherein the outer core has a Shore D hardness of 25 to 40 and a thickness of 0.3 to 1.0 mm, the core has a deformation amount of 3.45 to 3.95 mm when applying from an initial load of 98 N to a final load of 1275 N, and has a surface hardness in JIS-C hardness higher than a center hardness in JIS-C hardness by 5 to 20, and the outmost layer of the cover has a Shore D hardness of 60 to 64.

14 Claims, 3 Drawing Sheets

MULTI-PIECE SOLID GOLF BALL

FIELD OF THE INVENTION

The present invention relates to a multi-piece solid golf ball. More particularly, it relates to a multi-piece solid golf ball having very soft and good shot feel, and excellent rebound characteristics and flight performance, when hit by golfers who swing a golf club at low head speed.

BACKGROUND OF THE INVENTION

Golf balls, which are commercially selling, are typically classified into solid golf balls such as two-piece golf ball and three-piece golf ball, and thread wound golf balls. Recently, in the solid golf balls, flight distance can be improved while maintaining soft and good shot feel as good as a conventional thread wound golf ball. Therefore the solid golf balls occupy the greater part of the golf ball market. A multi-piece golf ball, which is represented by a three-piece golf ball, has good shot feel while maintaining excellent flight performance, because of accomplishing various hardness distributions as compared with the two-piece golf ball (Japanese Patent Kokoku publication No. 48473/1992, Japanese Patent Kokai publication Nos. 24084/1995, 322948/1997, 216271/1998 and 151320/1999).

Three-piece solid golf balls comprising a two-piece core, which are formed by placing an intermediate layer between the core and the cover of the two-piece solid golf ball, are suggested in Japanese Patent Kokai publication Nos. 322948/1997, 216271/1998 and 151320/1999. The intermediate layer is formed from vulcanized rubber material having the same composition as the core of the two-piece solid golf ball. These golf balls are characterized by controlling the thickness of the intermediate layer to not less than 1.5 mm, which is relatively thick, and the intermediate layer is softer than the inner core. Therefore the rebound characteristics are largely degraded, which reduces the flight distance when hit particularly by golfers who swing the golf club at low head speed.

Three-piece solid golf balls, of which the intermediate layer is formed from thermoplastic resin, are suggested in Japanese Patent Kokai publication No. 24084/1995, Japanese Patent Kokoku publication No. 48473/1992 and the like. In the golf ball described in Japanese Patent Kokai publication No. 24084/1995, of which the intermediate layer is softer than the inner core, it is restrained to degrade the rebound characteristics when compared with the three-piece solid golf ball having soft type intermediate layer formed from the above vulcanized rubber. However, since the deformation amount at a portion nearby the surface of the golf ball is large, the shot feel when hit by golfers who swing the golf club at high head speed is heavy and poor. In the golf ball described in Japanese Patent Kokoku publication No. 48473/1992, since the hardness of the inner core is not adjusted to a proper range, sufficient flight distance and shot feel are not obtained.

In order to solve the problem, for example in Japanese Patent Kokai publication No. 226151/1999, a multi-piece golf ball (comprising at least one layer of cover), of which the intermediate layer is formed from vulcanized rubber and is harder than the inner core, is suggested. However, in the golf ball, the intermediate layer is hard, the shot feel is hard and poor.

There has been no golf ball, which has both excellent flight performance and good shot feel. It is required to provide a multi-piece golf ball having better shot feel and better flight performance.

OBJECTS OF THE INVENTION

A main object of the present invention is to provide a multi-piece solid golf ball having soft and good shot feel, and having excellent rebound characteristics and flight performance, when hit by golfers who swing a golf club at low head speed.

According to the present invention, the object described above has been accomplished by adjusting the deformation amount and hardness distribution of the core having multi-layered structure, the hardness and thickness of the outer core, the hardness of the cover to a specified range, thereby providing a multi-piece solid golf ball having soft and good shot feel, and having excellent rebound characteristics and flight performance, when hit by golfers who swing a golf club at low head speed.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given herein below and the accompanying drawings which are given by way of illustration only, and thus are not limiting of the present invention.

SUMMARY OF THE INVENTION

The present invention provides a multi-piece solid golf ball comprising a core consisting of an inner core and an outer core formed on the inner core, and at least one layer of cover covering the core, wherein the outer core has a Shore D hardness of 25 to 40 and a thickness of 0.3 to 1.0 mm, the core has a deformation amount of 3.45 to 3.95 mm when applying from an initial load of 98 N to a final load of 1275 N, and a surface hardness in JIS-C hardness of the core is higher than a center hardness of the core by 5 to 20, and the outmost layer of the cover has a Shore D hardness of 60 to 64.

In order to put the present invention into a more suitable practical application, it is preferable that the golf ball have a deformation amount of 2.65 to 3.20 mm when applying from an initial load of 98 N to a final load of 1275 N and the outer core have a specific gravity larger than that of the inner core by 0.05.

DETAILED DESCRIPTION OF THE INVENTION

Figure 1:
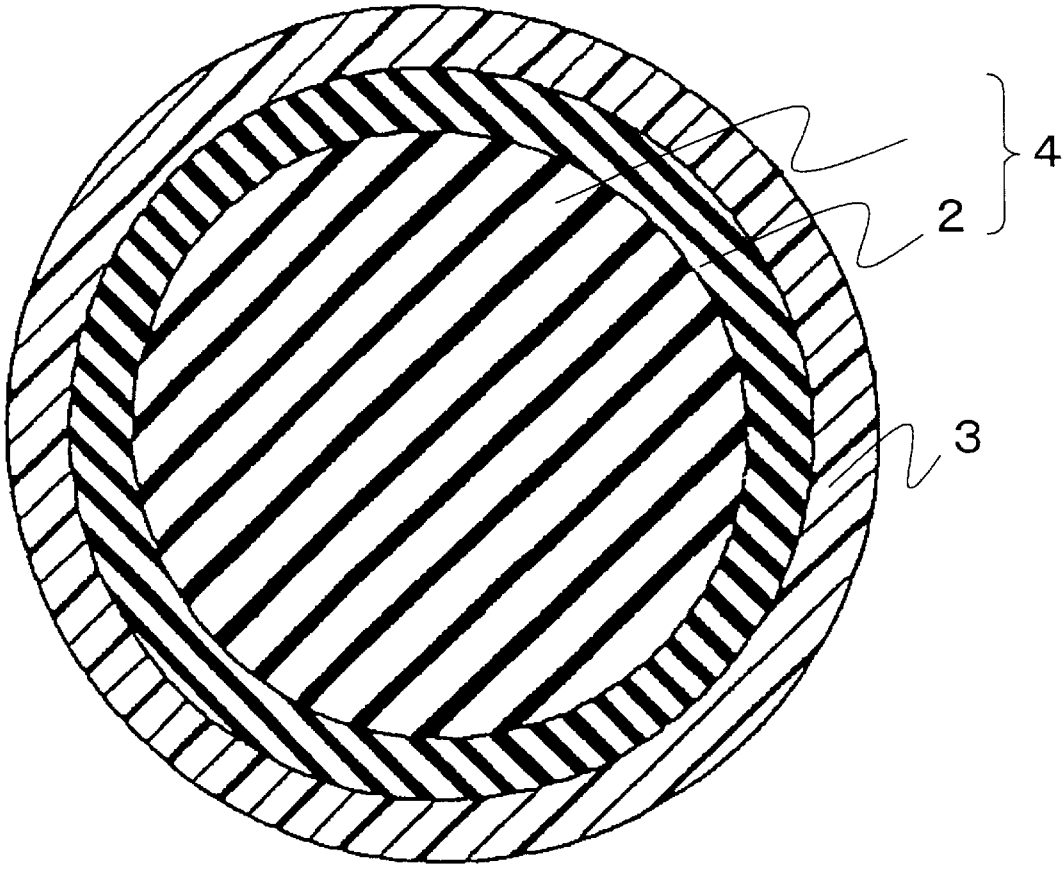
FIG. 1 is a schematic cross section illustrating one embodiment of the golf ball of the present invention.

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 4 consisting of an inner core 1 and an outer core 2 formed on the inner core 1, and at least one layer of cover 3 covering the core 4. In order to explain the golf ball of the present invention simply, a golf ball having one layer of cover 3 will be used hereinafter for explanation. However, the golf ball of the present invention may be also applied for the golf ball having two or more layers of cover.

The core 4, including both the inner core 1 and the outer core 2, is preferably obtained by press-molding a rubber composition under applied heat. The rubber composition essentially contains polybutadiene, a co-crosslinking agent, an organic peroxide and a filler.

The polybutadiene used for the core 4 of the present invention may be one, which has been conventionally used for cores of solid golf balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent can be a metal salt of α, β-unsaturated carboxylic acid, including mono or divalent metal salts, such as zinc or magnesium salts of α, β-unsaturated carboxylic acids having 3 to 8 carbon atoms (e.g. acrylic acid, methacrylic acid, etc.), or a blend of the metal salt of α, β-unsaturated carboxylic acid and acrylic ester or methacrylic ester and the like. The preferred co-crosslinking agent for the inner core 1 is a zinc salt of α, β-unsaturated carboxylic acid, particularly zinc acrylate, because it imparts high rebound characteristics to the resulting golf ball, and the preferred co-crosslinking agent for the outer core 2 is a magnesium salt of α, β-unsaturated carboxylic acid, particularly magnesium methacrylate because it imparts good releasability from a mold to the core. The amount of the co-crosslinking agent is from 5 to 70 parts by weight, preferably from 10 to 50 parts by weight, more preferably from 20 to 30 parts by weight, based on 100 parts by weight of the polybutadiene. When the amount of the co-crosslinking agent is larger than 70 parts by weight, the core is too hard, and the shot feel of the resulting golf ball is poor. On the other hand, when the amount of the co-crosslinking agent is smaller than 5 parts by weight, it is required to increase an amount of the organic peroxide in order to impart a desired hardness to the core. Therefore, the rebound characteristics are degraded, which reduces the flight distance.

When assuming that the amount of the co-crosslinking agent in the inner core is $A_0$ parts by weight and the amount of zinc acrylate in the inner core is $A_1$ parts by weight, a ratio $(A_1/A_0)$ is within the range of not less than 0.5, preferably not less than 0.8, more preferably not less than 0.9, most preferably 1.0 (using only zinc acrylate as a co-crosslinking agent). When the ratio $(A_1/A_0)$ is smaller than 0.5, the hardness of the inner core is low, and the resulting golf ball has poor shot feel so that the rebound characteristics are poor, or the rebound characteristics are degraded, which reduces the flight distance. When assuming that the amount of the co-crosslinking agent in the outer core is $B_0$ parts by weight and the amount of magnesium methacrylate in the outer core is $B_1$ parts by weight, a ratio $(B_1/B_0)$ is within the range of not less than 0.5, preferably not less than 0.8, more preferably not less than 0.9, most preferably 1.0 (using only magnesium methacrylate as a co-crosslinking agent). When the ratio $(B_1/B_0)$ is smaller than 0.5, the hardness of the outer core is low, and the rebound characteristics are degraded, which reduces the flight distance.

The organic peroxide includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.2 to 7.0 parts by weight, preferably 0.5 to 5.0 parts by weight, based on 100 parts by weight of the polybutadiene. When the amount of the organic peroxide is smaller than 0.2 parts by weight, the core is too soft, and the rebound characteristics of the resulting golf ball are degraded, which reduces the flight distance. On the other hand, when the amount of the organic peroxide is larger than 7.0 parts by weight, it is required to decrease an amount of the co-crosslinking agent in order to impart a desired hardness to the core. Therefore, the rebound characteristics are degraded, which reduces the flight distance.

The filler, which can be typically used for the core of solid golf ball, includes for example, inorganic filler (such as zinc oxide, barium sulfate, calcium carbonate, magnesium oxide and the like), high specific gravity metal powder filler (such as tungsten powder, molybdenum powder and the like), and the mixture thereof. The amount of the filler is from 3 to 50 parts by weight, preferably from 10 to 30 parts by weight, based on 100 parts by weight of the polybutadiene. When the amount of the filler is smaller than 3 parts by weight, it is difficult to adjust the weight of the resulting golf ball. On the other hand, when the amount of the filler is larger than 50 parts by weight, the weight ratio of the rubber component in the core is small, and the rebound characteristics reduce too much.

The rubber compositions for the inner core and outer core of the golf ball of the present invention can contain other components, which have been conventionally used for preparing the core of solid golf balls, such as antioxidant or peptizing agent. If used, the amount of the antioxidant is preferably 0.1 to 1.0 parts by weight, and the amount of the peptizing agent is preferably 0.1 to 5.0 parts by weight, based on 100 parts by weight of the polybutadiene.

Figure 2:
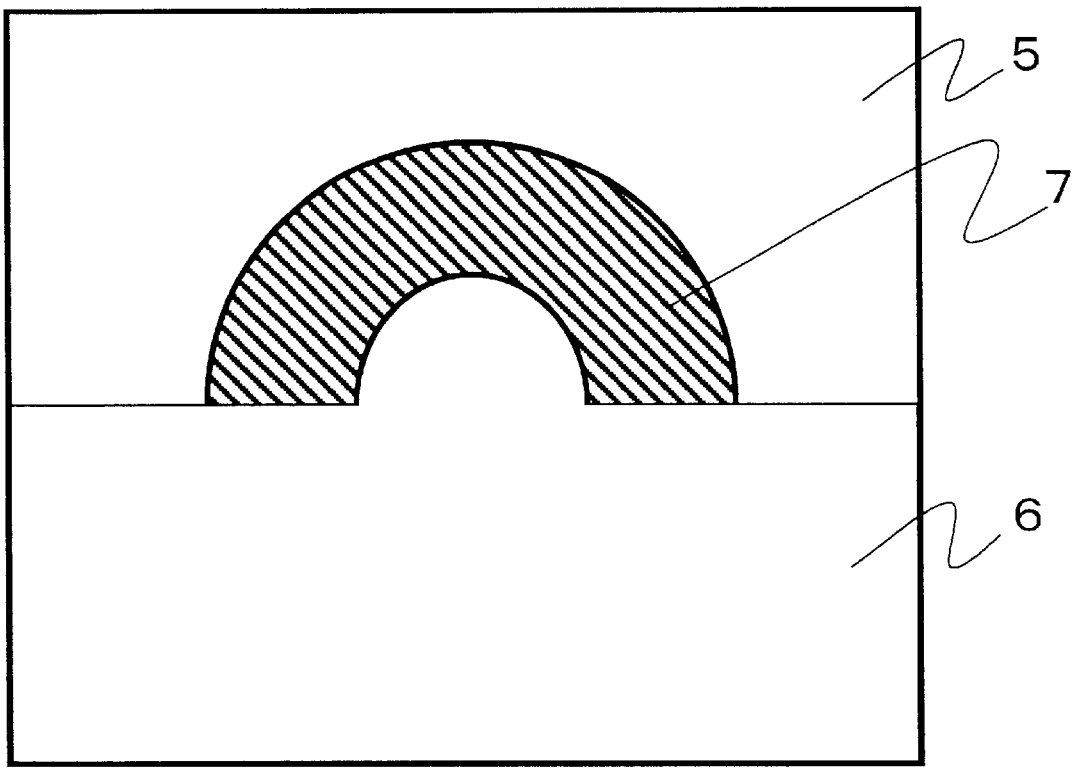
FIG. 2 is a schematic cross section illustrating one embodiment of a mold for molding an outer core of the golf ball of the present invention.
Figure 3:
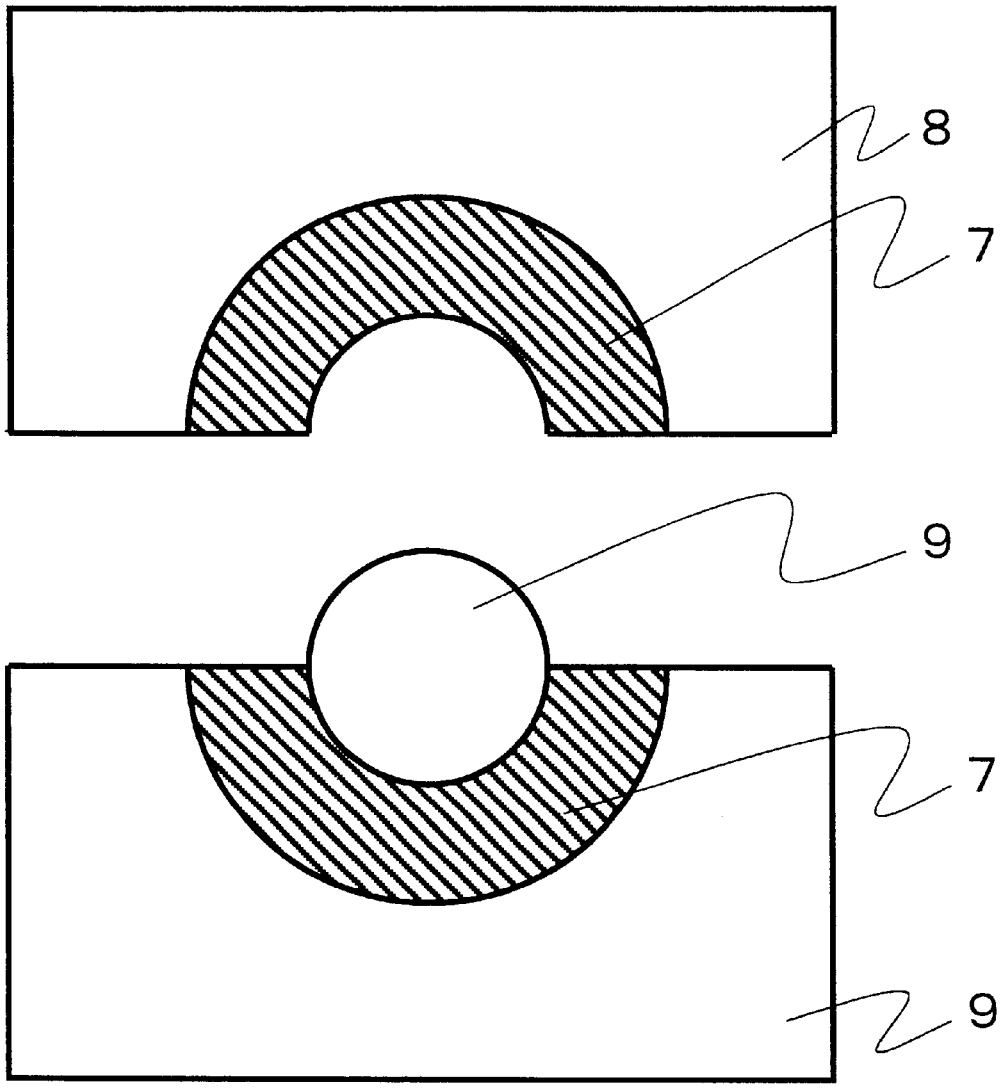
FIG. 3 is a schematic cross section illustrating one embodiment of a mold for molding a core of the golf ball of the present invention.

The process of producing the two-layer structured core of the golf ball of the present invention will be explained with reference to FIG. 2 and FIG. 3. FIG. 2 is a schematic cross section illustrating one embodiment of a mold for molding an outer core of the golf ball of the present invention. FIG. 3 is a schematic cross section illustrating one embodiment of a mold for molding a core of the golf ball of the present invention. The rubber composition for the inner core is molded by using an extruder to form a cylindrical unvulcanized inner core. The rubber composition for the outer core is then vulcanized by press-molding, for example, at 120 to 160° C. for 2 to 30 minutes using a mold having a semi-spherical cavity 5 and a male plug mold 6 having a semi-spherical convex having the same shape as the inner core as described in FIG. 2 to obtain a vulcanized semi-spherical half-shell 7 for the outer core. The unvulcanized inner core 9 is covered with the two vulcanized semi-spherical half-shells 7 for the outer core, and then vulcanized by integrally press-molding, for example, at 140 to 180° C. for 10 to 60 minutes in a mold 8 for molding a core, which is composed of an upper mold and a lower mold, as described in FIG. 3 to obtain the core 4. The core 4 is composed of the inner core 1 and the outer core 2 formed on the inner core.

In the golf ball of the present invention, the core 4 has a diameter of 36.8 to 40.0 mm, preferably 37.0 to 39.5 mm, more preferably 37.5 to 39.0 mm. When the diameter of the core is smaller than 36.8 mm, effect of the cover on the properties of the golf ball is too large, and the technical effect accomplished by the presence of the core is not sufficiently obtained. Therefore, the rebound characteristics are degraded, or the shot feel is hard and poor. On the other hand, when the diameter of the core is larger than 40.0 mm, the technical effect accomplished by the presence of the cover is not sufficiently obtained. Therefore, the rebound characteristics are degraded, which reduces the flight distance.

In the golf ball of the present invention, it is required for the core 4 to have a deformation amount when applying from an initial load of 98 N to a final load of 1275 N of 3.45 to 3.95 mm, preferably 3.50 to 3.85 mm, more preferably 3.60 to 3.85 mm. When the deformation amount is smaller than 3.45 mm, the core is hard, and the shot feel is poor particularly when hit by golfers who swing a golf club at low head speed. On the other hand, when the deformation amount is larger than 3.95 mm, the deformation amount at the time of hitting is too large, and the rebound characteristics are degraded. In addition, the shot feel is heavy and poor.

In the golf ball of the present invention, it is required for the core 4 to have a surface hardness in JIS-C hardness higher than a center hardness in JIS-C hardness by 5 to 20, preferably 6 to 19, more preferably 7 to 18. When the hardness difference is smaller than 5, the surface of the core is too soft, and the rebound characteristics are degraded. Otherwise, the center hardness of the core is too large, and the shot feel is hard and poor. On the other hand, when the hardness difference is larger than 20, the surface of the core is too hard, and the shot feel is hard and poor. Otherwise, the center hardness of the core is too small, and the rebound characteristics are degraded.

It is desired for the core 4 to have the center hardness in JIS-C hardness of 50 to 70, preferably 55 to 68, more preferably 58 to 63. When the hardness is smaller than 50, the shot feel is heavy and poor, and the core is too soft and the rebound characteristics are degraded, which reduces the flight distance. On the other hand, when the hardness is larger than 70, the shot feel is hard and poor, and the rebound characteristics are sufficiently obtained, but the launch angle is small, which reduces the flight distance.

It is desired for the core 4 to have the surface hardness in JIS-C hardness of 60 to 80, preferably 65 to 76, more preferably 70 to 76. When the hardness is smaller than 60, the shot feel is heavy and poor, and the inner core is too soft, and the rebound characteristics are degraded, which reduces the flight distance. On the other hand, when the hardness is larger than 80, the core is too hard, and the shot feel is poor.

The center hardness of the core 4 is determined by measuring a hardness at the center point of the core in section, after the core 4, which is formed by integrally press-molding the inner core and the outer core, is cut into two equal parts. The surface hardness of the core 4 is determined by measuring a hardness at the surface of the core 4, after molding the core as described above.

In the golf ball of the present invention, it is required for the outer core 2 to have a Shore D hardness of 25 to 40, preferably 27 to 37, more preferably 30 to 35. When the hardness is smaller than 25, the outer core is too soft, and the rebound characteristics of the resulting golf ball are degraded. The energy loss is large because only a part of the golf ball deforms too much, and the flight performance is degraded. On the other hand, when the hardness is larger than 40, the surface of the core is too hard, and the shot feel is poor. The hardness of the outer core 2 is determined by measuring a Shore D hardness according to ASTM D-2240, using a sample of a stack of the three or more heat and press molded sheet having a thickness of about 2 mm from the composition for the outer core, which had been stored at 23° C. for 2 weeks.

In the golf ball of the present invention, it is required for the outer core 2 to have a thickness of 0.3 to 1.0 mm, preferably 0.3 to 0.9 mm, more preferably 0.4 to 0.9 mm. When the thickness is larger than 1.0 mm, the effect of the hardness of the outer core is larger than that of the performance of the inner core, and the performance of the golf ball is not sufficiently obtained. On the other hand, when the thickness is smaller than 0.3 mm, the technical effect accomplished by the presence of the outer core is not sufficiently obtained.

In the golf ball of the present invention, the inner core 1 has a diameter of 34.8 to 39.4 mm, preferably 35.5 to 39.0 mm, more preferably 36.0 to 38.5 mm. When the diameter of the inner core is smaller than 34.8 mm, it is required to increase the thickness of the outer core or the cover to a thickness more than a desired thickness. Therefore, the rebound characteristics are degraded, or the shot feel is hard and poor. On the other hand, when the diameter of the inner core is larger than 39.4 mm, it is required to decrease the thickness of the outer core or the cover to a thickness less than a desired thickness. Therefore the technical effect accomplished by the presence of the outer core is not sufficiently obtained. The diameter of the inner core 1 is determined by measuring a diameter of the inner core 1 in section, after the core 4, which is formed by integrally press-molding the inner core and the outer core, is cut into two equal parts.

In the golf ball of the present invention, it is desired for the inner core 1 to have the surface hardness in JIS-C hardness of 70 to 90, preferably 75 to 85. When the hardness is smaller than 70, the shot feel is heavy and poor, and the inner core is too soft, and the rebound characteristics are degraded, which reduces the flight distance. On the other hand, when the hardness is larger than 90, the shot feel is hard and poor.

In the golf ball of the present invention, it is desired for the outer core 2 to have a specific gravity larger than that of the inner core 1 by not less than 0.05, preferably 0.05 to 0.3, more preferably 0.1 to 0.25. When the specific gravity difference is smaller than 0.05, the specific gravity of the inner core is large, and it is required to use a large amount of filler, which degrades the rebound characteristics.

It is desired for the inner core 1 to have the specific gravity of 1.00 to 1.20, preferably 1.02 to 1.18, more preferably 1.05 to 1.17. When the specific gravity of the inner core 1 is smaller than 1.00, the amount of the co-crosslinking agent is small, and the rebound characteristics are degraded. On the other hand, when the specific gravity of the inner core 1 is larger than 1.20, the amount of the filler is too large, and the rebound characteristics are degraded. In addition, it is required to decrease the specific gravity of the outer core or cover in order to adjust the weight of the golf ball to a range of standardized value, and the moment of inertia is small, which reduces the flight distance.

It is desired for the outer core 2 to have the specific gravity of 1.05 to 1.40, preferably 1.10 to 1.35, more preferably 1.20 to 1.30. When the specific gravity of the outer core 2 is smaller than 1.05, the amount of the co-crosslinking agent is small, and the rebound characteristics are degraded. On the other hand, when the specific gravity of the outer core 2 is larger than 1.40, the amount of the filler is too large, and the rebound characteristics are degraded.

In the golf ball of the present invention, the outer core 2 is preferably formed by press-molding the rubber composition as used in the inner core 1, which essentially contains polybutadiene, a co-crosslinking agent, an organic peroxide and a filler. Since the outer core 2, which is not formed from thermoplastic resin, such as ionomer resin, thermoplastic elastomer, diene-based copolymer and the like, is formed from the press-molded article of the rubber composition, the rebound characteristics are improved. When the outer core is formed from thermoplastic resin, the outer core can be prepared by injection molding. However, it is difficult to prepare the outer core 2 of the present invention by injection molding, because the outer core 2 has a thickness of 0.2 to 1.3 mm, which is very thin.

Since the inner core 1 and the outer core 2 are formed from the same vulcanized rubber composition, the adhesion between the inner core 1 and the outer core 2 is excellent, and the durability is improved. Rubber, when compared with resin, has a little deterioration of performance at low temperature lower than room temperature as known in the art, and thus the outer core of the present invention formed from the rubber has excellent rebound characteristics at low temperature.

At least one layer of cover 3 are then covered on the core 4. In the golf ball of the present invention, the cover 3 preferably has single-layer structure, that is, a three-piece solid golf ball, in view of productivity, but the cover may have multi-layer structure, which has two or more layers.

In the golf ball of the present invention, it is required for the outermost layer of the cover 3 to have a Shore D hardness of 60 to 64, preferably 61 to 64, more preferably 61 to 63. When the hardness is smaller than 60, the deformation amount of the surface of the golf ball at the time of hitting is large even if the hardness of the core is adjusted, the rebound characteristics are poor and the shot feel is heavy and poor. On the other hand, when the hardness is larger than 64, the cover hardness is very hard, and the shot feel is poor, particularly when hit by golfers who swing a golf club at low head speed. The hardness of the cover 3 as used herein is determined by measuring a Shore D hardness according to ASTM D-2240, using a sample of a stack of the three or more heat and press molded sheet having a thickness of about 2 mm from the composition for the cover, which had been stored at 23° C. for 2 weeks.

It is desired for the cover 3 to have a thickness of 1.5 to 3.5 mm, preferably 1.8 to 2.5 mm, more preferably 1.95 to 2.45 mm. When the thickness is smaller than 1.5 mm, the rebound characteristics are degraded, which reduces the flight distance. On the other hand, when the thickness is larger than 3.5 mm, the shot feel is hard and poor. If the cover 3 has two or more layers, the thickness of each layer is not limited as long as the total thickness of the cover layers is within the above range.

The cover 3 of the present invention contains thermoplastic resin, particularly ionomer resin, which has been conventionally used for the cover of golf balls, as a base resin. The ionomer resin may be a copolymer of ethylene and α, β-unsaturated carboxylic acid, of which a portion of carboxylic acid groups is neutralized with metal ion, or a terpolymer of ethylene, α, β-unsaturated carboxylic acid and α, β-unsaturated carboxylic acid ester, of which a portion of carboxylic acid groups is neutralized with metal ion. Examples of the α, β-unsaturated carboxylic acid in the ionomer include acrylic acid, methacrylic acid, fumaric acid, maleic acid, crotonic acid and the like, preferred are acrylic acid and methacrylic acid. Examples of the α, β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the cover 3 of the present invention, the above ionomer resin may be used alone, but the ionomer resin may be used in combination with at least one of thermoplastic elastomer, diene-based block copolymer and the like.

Examples of the thermoplastic elastomers include polyamide-based thermoplastic elastomer, which is commercially available from Toray Co., Ltd. under the trade name of "Pebax" (such as "Pebax 2533"); polyester-based thermoplastic elastomer, which is commercially available from Toray-Do Pont Co., Ltd. under the trade name of "Hytrel" (such as "Hytrel 3548", "Hytrel 4047"); polyurethane-based elastomer, which is commercially available from Takeda Verdishe Co., Ltd. under the trade name of "Elastollan" (such as "Elastollan ET880"); and the like.

The diene-based block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene block copolymers which is commercially available include the diene block copolymers, which are commercially available from Daicel Chemical Industries, Ltd. under the trade name of "Epofriend" (such as "Epofriend A1010") and the like.

The amount of the thermoplastic elastomer or diene block copolymer is 1 to 60 parts by weight, preferably 1 to 35 parts by weight, based on 100 parts by weight of the base resin for the cover. When the amount is smaller than 1 parts by weight, the technical effect of absorbing the impact force at the time of hitting accomplishing by using them is not sufficiently obtained. On the other hand, when the amount is larger than 60 parts by weight, the cover is too soft and the rebound characteristics are degraded, or the compatibility with the ionomer resin is degraded and the durability is degraded.

The composition for the cover 3 used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core 4 with the cover 3 is not specifically limited, but may be a conventional method. For example, there can be used a method comprising molding the cover composition into a semi-spherical half-shell in advance, covering the core, which is covered with the outer core, with the two half-shells, followed by pressure molding at 130 to 170° C. for 1 to 5 minutes, or a method comprising injection molding the cover composition directly on the core, which is covered with the core, to cover it. At the time of molding the cover, many depressions called "dimples" may be optionally formed on the surface of the golf ball. Furthermore, paint finishing or marking with a stamp may be optionally provided after the cover molded for commercial purposes.

In the golf ball of the present invention, it is desired to have a deformation amount, when applying from an initial load of 98 N to a final load of 1275 N, of 2.65 to 3.20 mm, preferably 2.70 to 3.15 mm, more preferably 2.80 to 3.00 mm. When the deformation amount is smaller than 2.65 mm, the shot feel is hard and poor when hit by golfers who swing a golf club at low head speed even if the deformation amount of the core is adjusted to a proper range. On the other hand, when the deformation amount is larger than 3.20 mm, the golf ball is too soft, and the shot feel is heavy and poor.

EXAMPLES

The following Examples and Comparative Examples further illustrate the present invention in detail but are not to be construed to limit the scope of the present invention.

(i) Production of Unvulcanized Inner Core

The rubber compositions for the inner core having the formulation shown in Table 1 were mixed, and then extruded to obtain cylindrical unvulcanized molded articles (plugs).

TABLE 1

| Inner core composition | (parts by weight) I | II | III |
|---|---|---|---|
| BR-11 *1 | 100 | 100 | 100 |
| Zinc acrylate | 21 | 19 | 23 |
| Zinc oxide | 17.5 | 18.0 | 16.5 |
| Tungsten | 5 | 5 | 5 |
| Dicumyl peroxide | 0.8 | 0.8 | 0.8 |

*1: High-cis polybutadiene (trade name "BR-11") available from JSR Co., Ltd. (Content of 1,4-cis-polybutadiene: 96%)

(ii) Production of Vulcanized Semi-spherical Half-shell for the Outer Core

The rubber compositions for the outer core having the formulation shown in Table 2 were mixed, and then vulcanized by press-molding at the vulcanization condition shown in the same Table in the mold (5, 6) as described in FIG. 2 to obtain vulcanized semi-spherical half-shells 7 for the outer core. A hardness was determined by measuring a Shore D hardness according to ASTM D-2240, using a sample of a stack of the three or more heat and press molded sheet having a thickness of about 2 mm from the composition for the outer core, which had been stored at 23° C. for 2 weeks. The result is shown as outer core hardness in Tables 2, 4 and 5.

TABLE 2

| Outer core composition | (parts by weight) A | B | C |
|---|---|---|---|
| BR-11 *1 | 100 | 100 | 100 |
| Magnesium methacrylate | 24 | 24 | 24 |
| Magnesium oxide | 22 | 22 | 22 |
| Tungsten | 10 | 10 | 10 |
| Barium sulfate | 26 | 26 | 26 |
| Dicumyl peroxide | 3.5 | 1.5 | 0.5 |
| Outer core hardness (Shore D hardness) | 48 | 30 | 22 |

*1: High-cis polybutadiene (trade name "BR-11") available from JSR Co., Ltd. (Content of 1,4-cis-polybutadiene: 96%)

(iii) Production of Core

The unvulcanized molded articles 9 for the inner core produced in the step (i) were covered with the two vulcanized semi-spherical half-shells 7 for the outer core produced in the step (ii), and then vulcanized by press-molding at the vulcanization condition shown in Table 4 (Examples) and Table 5 (Comparative Examples) in the mold 8 as described in FIG. 3 to obtain cores 4 having a two-layered structure. A surface hardness in JIS-C hardness of the resulting core 4 was measured. The results are shown in the same Tables as a surface hardness of the core (b). The diameter and specific gravity (d) of the inner core, the thickness and specific gravity (e) of the outer core and the center hardness (a) and deformation amount of the core were, also measured, and the hardness difference (b-a) and specific gravity difference (e-d) were calculated. The results are shown in the same Tables.

(iv) Preparation of Cover Compositions

The formulation materials showed in Table 3 [Table 4 (Examples) and Table 5 (Comparative Examples)] were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 150 to 260° C. at the die position of the extruder. A hardness was determined by measuring a Shore D hardness according to ASTM D-2240, using a sample of a stack of the three or more heat and press molded sheet having a thickness of about 2 mm from the composition for the cover, which had been stored at 23° C. for 2 weeks. The result is shown as a cover hardness in Tables 3 to 5.

TABLE 3

| Cover composition | (parts by weight) X | Y |
|---|---|---|
| Hi-milan 1605 *2 | 50 | 20 |
| Hi-milan 1706 *3 | 50 | 20 |
| Hi-milan 1855 *4 | — | 60 |

TABLE 3-continued

| Cover composition | (parts by weight) X | Y |
|---|---|---|
| Cover hardness (Shore D hardness) | 63 | 58 |

*2: Hi-milan 1605 (trade name), ethylene-methacrylic acid copolymer ionomer resin obtained by neutralizing with sodium ion, manufactured by Mitsui Du Pont Polychemical Co., Ltd., Shore D hardness: 62, flexural modulus: 310 MPa
*3: Hi-milan 1706 (trade name), ethylene-methacrylic acid copolymer ionomer resin obtained by neutralizing with zinc ion, manufactured by Mitsui Du Pont Polychemical Co., Ltd., Shore D hardness: 60, flexural modulus: 270 MPa
*4: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd., Shore D hardness: 54, flexural modulus: 87 MPa

Examples 1 to 4 and Comparative Examples 1 to 4

The cover composition was covered on the resulting core 4 having two-layered structure by injection molding to form a cover layer 3 having the thickness shown in Table 4 (Examples) and Table 5 (Comparative Examples). Then, paint was applied on the surface to produce golf ball having a diameter of 42.7 mm. With respect to the resulting golf balls, the deformation amount, restitution, flight distance and shot feel were measured or evaluated. The results are shown in the same Tables. The test methods are as follows.

Test Method (1) Hardness (i) Core Hardness

The center hardness of the core is determined by measuring a JIS-C hardness at the center point of the core in section, after the two-layer structured core, which is formed by integrally press-molding the inner core and the outer core, is cut into two equal parts. The surface hardness of the core is determined by measuring a JIS-C hardness at the surface of the core, after molding the core as described above. The JIS-C hardness was measured at 20° C. using a JIS-C hardness meter according to JIS K 6301.

(ii) Outer Core Hardness and Cover Hardness a) When formed from rubber composition, a sheet having a thickness of about 2 mm was formed by vulcanizing and press-molding the rubber composition at 155° C. for 35 minutes in a mold. The hardness was determined by measuring a Shore D hardness according to ASTM D-2240, using a sample of a stack of the three or more sheet, which had been stored at 23° C. for 2 weeks.

b) When formed from thermoplastic resin, a sheet having a thickness of about 2 mm was formed by injection-molding. The hardness was determined by measuring a Shore D hardness according to ASTM D-2240, using a sample of a stack of the three or more sheet, which had been stored at 23° C. for 2 weeks.

The Shore D hardness was measured at 23° C. using a Shore D hardness meter according to ASTM D-2240-68.

(2) Flight Performance

A No. 1 wood club (W#1, a driver) having metal head was mounted to a swing robot manufactured by True Temper Co. and the resulting golf ball was hit at a head speed of 40 m/second, the flight distance were measured. As the flight distance, carry that is a distance to the dropping point of the hit golf ball was measured. The measurement was conducted by using 12 golf balls for every sample (n=12), and the average is shown as the result of the golf ball.

(3) Shot Feel

The shot feel of the resulting golf ball was evaluated by 10 golfers who swing the golf club at a head speed of not more than 43 m/second according to practical hitting test using a No. 1 wood club (W#1, a driver). The evaluation criteria are as follows.

Evaluation Criteria oo: Not less than eight golfers felt that the golf ball has good shot feel.

o: Six to seven golfers felt that the golf ball has good shot feel.

Δ: Four to five golfers felt that the golf ball has good shot feel.

x: Not more than three golfers felt that the golf ball has good shot feel.

Test Results

TABLE 4

| | Example No. 1 | 2 | 3 | 4 |
|---|---|---|---|---|
| (Inner core) | | | | |
| Composition | I | III | III | I |
| Diameter (mm) | 37.6 | 37.6 | 37.0 | 37.6 |
| Specific gravity (d) | 1.15 | 1.15 | 1.15 | 1.15 |
| (Outer core) | | | | |
| Composition | B | B | B | B |
| Thickness (mm) | 0.6 | 0.6 | 0.9 | 0.4 |
| Hardness (Shore D) | 30 | 30 | 30 | 30 |
| Specific gravity (e) | 1.27 | 1.27 | 1.27 | 1.27 |
| Difference (e − d) | 0.12 | 0.12 | 0.12 | 0.12 |
| Vulcanization condition of core | | | | |
| Temperature (° C.) | 150 | 160 | 150 | 150 |
| Time (min) | 35 | 30 | 35 | 35 |
| (Core) | | | | |
| Deformation amount (mm) | 3.85 | 3.70 | 3.60 | 3.80 |
| Hardness (JIS-C) Center (a) | 62 | 58 | 63 | 62 |
| Surface (b) | 72 | 76 | 70 | 74 |
| (b − a) | 10 | 18 | 7 | 12 |
| (Cover) | | | | |
| Composition | X | X | X | X |
| Hardness (Shore D) | 63 | 63 | 63 | 63 |
| Thickness (mm) | 2.0 | 2.0 | 2.0 | 2.0 |
| Ball deformation amount (mm) | 3.00 | 2.90 | 2.80 | 2.95 |
| Coefficient of restitution | 1.01 | 1.01 | 1.01 | 1.02 |
| Flight distance (m) | 192.0 | 192.5 | 192.5 | 193.0 |
| Shot feel | ∞ | ∞ | ∞ | ∞ |

TABLE 5

| | Comparative Example No. 1 | 2 | 3 | 4 |
|---|---|---|---|---|
| (Inner core) | | | | |
| Composition | III | II | I | III |
| Diameter (mm) | 37.6 | 37.6 | 37.0 | 37.6 |
| Specific gravity (d) | 1.15 | 1.15 | 1.15 | 1.15 |
| (Outer core) | | | | |
| Composition | B | B | C | A |
| Thickness (mm) | 0.6 | 0.6 | 0.9 | 0.6 |
| Hardness (Shore D hardness) | 30 | 30 | 22 | 48 |

TABLE 5-continued

| | | Comparative Example No. | | | |
|---|---|---|---|---|---|
| | | 1 | 2 | 3 | 4 |
| Specific gravity (e) | | 1.27 | 1.27 | 1.27 | 1.27 |
| Difference (e − d) | | 0.12 | 0.12 | 0.12 | 0.12 |
| Vulcanization condition of core | | | | | |
| Temperature (° C.) | | 150 | 150 | 150 | 145 |
| Time (min) | | 35 | 30 | 35 | 40 |
| (Core) | | | | | |
| Deformation amount (mm) | | 3.60 | 4.10 | 3.90 | 3.40 |
| Hardness | Center (a) | 63 | 60 | 62 | 65 |
| (JIS-C) | Surface (b) | 73 | 70 | 66 | 79 |
| | Difference (b − a) | 10 | 10 | 4 | 14 |
| (Cover) | | | | | |
| Composition | | Y | X | X | X |
| Hardness (Shore D hardness) | | 58 | 63 | 63 | 63 |
| Thickness (mm) | | 2.0 | 2.0 | 2.0 | 2.0 |
| Ball deformation amount (mm) | | 3.00 | 3.25 | 3.00 | 2.60 |
| Coefficient of restitution | | 1.00 | 0.98 | 0.99 | 1.02 |
| Flight distance (m) | | 191.0 | 190.0 | 191.5 | 193.0 |
| Shot feel | | Δ | Δ | ○ | × |

As is apparent from the results of Tables 4 to 5, the golf balls of the present invention of Examples 1 to 4, of which the deformation amount and hardness distribution of the core, the hardness and thickness of the outer core, the hardness of the cover are adjusted to a specified range, have very soft and good shot feel, and have excellent rebound characteristics and flight performance, when hit by golfers who swing a golf club at low head speed, as compared with the golf balls of Comparative Examples 1 to 4.

On the other hand, in the golf ball of Comparative Example 1, the coefficient of restitution and flight distance are small and the shot feel, of which the evaluation result is "Δ", is poor so that the rebound characteristics are poor, because the hardness of the cover is low. The shot feel is heavy and poor when hit by golfers who swing a golf club at low head speed using a driver and the spin amount is large, which reduces the flight distance, because the thickness of the outer cover is low.

In the golf ball of Comparative Example 2, the shot feel, of which the evaluation result is "Δ", is heavy and poor so that the rebound characteristics are poor, because the deformation amount of the core is large.

In the golf ball of Comparative Example 3, the rebound characteristics are degraded, which reduces the flight distance and the shot feel is poorer than that of Examples so that the rebound characteristics are slightly poor, because the hardness of the outer core is low and the hardness difference between the center hardness and surface hardness of the core is small.

In the golf ball of Comparative Example 4, the impact force at the time of hitting is large, and the shot feel, of which the evaluation result is "x", is hard and poor, because the hardness of the outer core is high and the deformation amount of the core is small.

What is claimed is:

1. A multi-piece solid golf ball comprising a core consisting of an inner core and an outer core formed on the inner core, and at least one layer of cover covering the core, wherein the outer core has a Shore D hardness of 25 to 40 and a thickness of 0.3 to 1.0 mm, and said outer core is formed from a rubber composition comprising polybutadiene, a co-crosslinking agent, an organic peroxide and a filler;

the core has a deformation amount of 3.60 to 3.85 mm when applying from an initial load of 98 N to a final load of 1275 N, and has a surface hardness in JIS-C hardness higher than a center hardness in JIS-C hardness by 5 to 20;

the outmost layer of the cover has a Shore D hardness of 60 to 64; and the golf ball has a deformation amount of 2.80 to 3.00 mm when applying from an initial load of 98 N to a final load of 1275 N.

2. The multi-piece solid golf ball according to claim 1, wherein the co-crosslinking agent for the outer core is a magnesium salt of α, β-unsaturated carboxylic acid.

3. The multi-piece solid golf ball according to claim 1, wherein the outer core has a specific gravity larger than that of the inner core by not less than 0.05.

4. The multi-piece solid golf ball according to claim 1, wherein said polybutadiene is high-cis polybutadiene rubber.

5. The multi-piece solid golf ball according to claim 1, wherein said co-crosslinking agent for the outer core is magnesium methacrylate.

6. The multi-piece solid golf ball according to claim 1, wherein said inner core is formed from a rubber composition comprising polybutadiene, a co-crosslinking agent, an organic peroxide and a filler.

7. The multi-piece solid golf ball according to claim 6, wherein said co-crosslinking agent for the inner core is a zinc salt of α, β-unsaturated carboxylic acid.

8. The multi-piece solid golf ball according to claim 6, wherein said co-crosslinking agent for the inner core is zinc acrylate.

9. The multi-piece solid golf ball according to claim 1, wherein the deformation amount for said core is 3.70 to 3.85 mm.

10. The multi-piece solid golf ball according to claim 1, wherein the deformation amount for said golf ball is 2.90 to 3.00 mm.

11. The multi-piece solid golf ball according to claim 1, wherein said core has the surface hardness in JIS-C hardness higher than the center hardness in JIS-C hardness by 7 to 18.

12. The multi-piece solid golf ball according to claim 1, wherein the outermost layer of the cover has a Shore D hardness of 61 to 64.

13. The multi-piece solid golf ball according to claim 1, wherein the outermost layer of the cover has a Shore D hardness of 61 to 63.

14. The multi-piece solid golf ball according to claim 1, wherein said cover has a thickness of 1.5 to 3.5 mm.

* * * * *